US005873766A

United States Patent [19]

Burton

[11] Patent Number: 5,873,766

[45] Date of Patent: Feb. 23, 1999

[54] TOY CLAPPER

[76] Inventor: Michael Burton, 18469 Roselawn, Detroit, Mich. 48221

[21] Appl. No.: 657,725

[22] Filed: May 3, 1996

Related U.S. Application Data

[60] Provisional application No. 60/001,936 Aug. 4, 1995.

[51] Int. Cl.[6] ..... A63H 5/00

[52] U.S. Cl. ..... 446/421; 446/419; 446/486; 446/489

[58] Field of Search ..... 446/415, 418, 446/419, 421, 486, 487, 488, 491, 489; 428/7, 9, 12

[56] References Cited

U.S. PATENT DOCUMENTS 4,014,088 3/1977 Oshier ..... 29/407
4,884,328 12/1989 Neighbors ..... 446/217
4,886,687 12/1989 Malott ..... 428/4
5,130,169 7/1992 DeJaynes ..... 428/7
5,609,928 3/1997 Yedlin et al. ..... 428/7

*Primary Examiner*—Kien T. Nguyen
*Assistant Examiner*—Jeffrey D. Carlson
*Attorney, Agent, or Firm*—Rader, Fishman & Grauer PLLC

[57] ABSTRACT

A toy capable of emitting clapping noise, emitting scent, and emitting light. The toy is constructed with an elongated central member and a plurality of resilient ribs which are attached at one of their ends to the elongated central member and are attached at their other end to a sliding collar. The sliding collar is free to slide along the elongated member thereby causing the resilient ribs to move radially outwardly with respect to the longitudinal axis of the elongated central member.

8 Claims, 2 Drawing Sheets

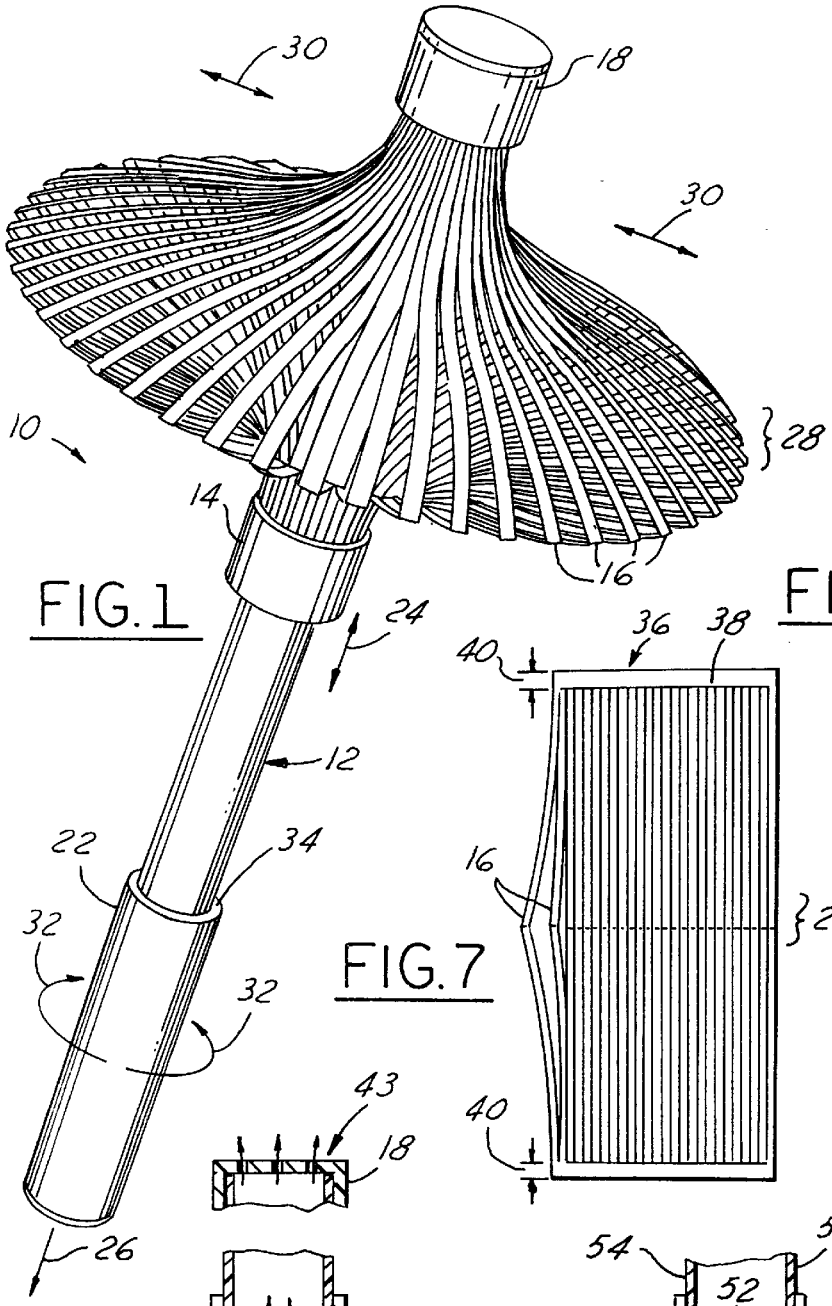
FIG. 1
FIG. 7
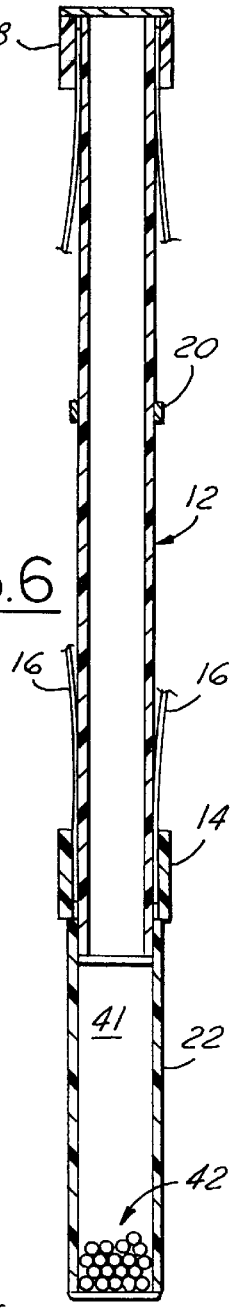
FIG. 6
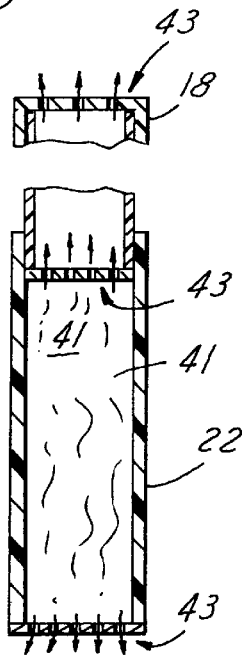
FIG. 8
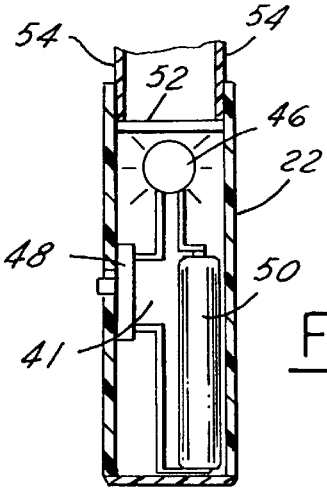
FIG. 9

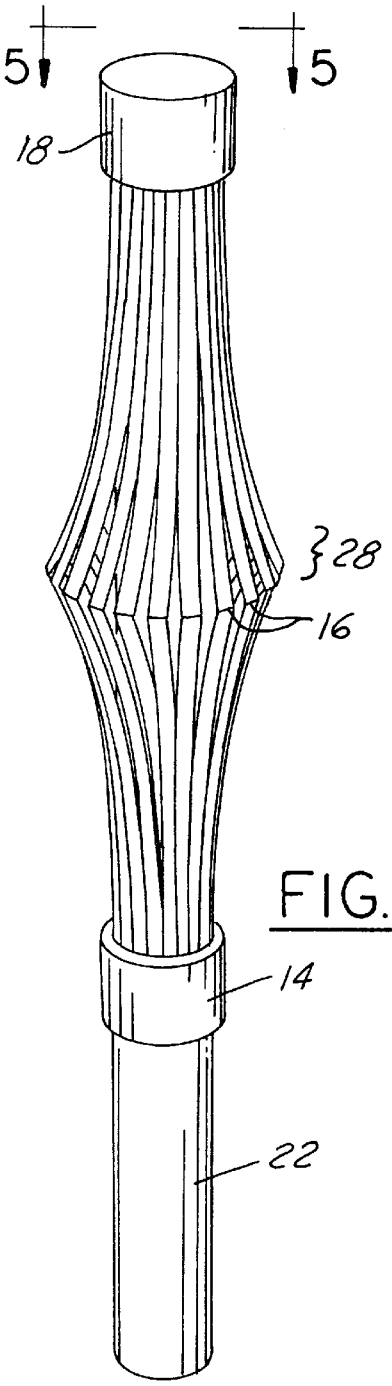
FIG. 4
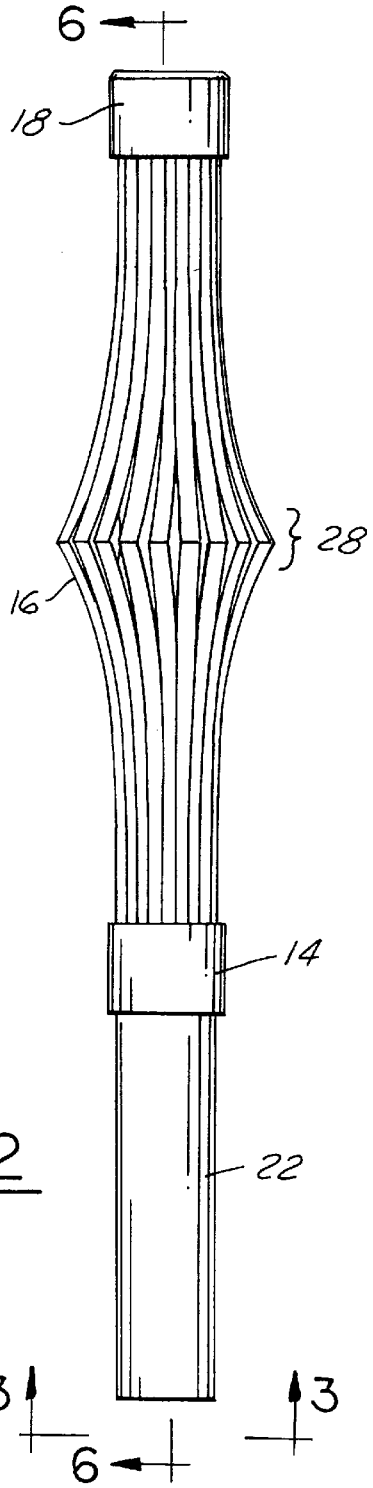
FIG. 2
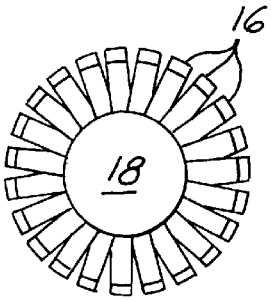
FIG. 5
FIG. 3
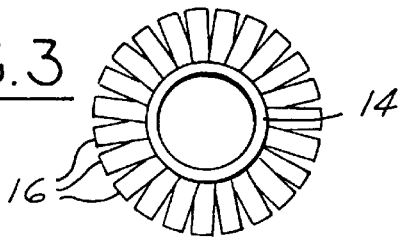

TOY CLAPPER

TECHNICAL FIELD

This is a provisional application Ser. No. 60/001936 filed Aug. 4, 1995.

This invention generally relates to novelty devices and more particularly to toys which create audio, visual, and olfactory effects.

BACKGROUND OF THE INVENTION

Novelty devices such as pennants, pinwheels, and like devices are commonly used by spectators who attend sporting events such as baseball, basketball, football etc. These novelty devices are designed to be waved or otherwise displayed by the patrons and often produce audible and visual effects which aid the user in expressing excitement during the event of interest.

The novelty device of the present invention combines audio, visual, and olfactory effects, is safe to use, and relatively inexpensive to produce.

SUMMARY OF THE INVENTION

The present invention includes an elongated central member having first and second ends and a longitudinal axis. A sliding collar captures the central member and is adapted to freely slide along the central member. A plurality of resilient rib elements are attached to both the sliding collar and a first location along the elongated central member such that the resilient elements urge the sliding collar away from the first location along the elongated central member. The resilient rib elements are adapted to flex radially outward with respect to the longitudinal axis of the elongated central member in response to certain forces.

Preferably, A stop element is attached to the elongated central member to limit the sliding movement of the sliding collar. Preferably the rib elements are comprised of mylar and the central member is comprised of clear plastic tubing.

In alternative embodiments of the present invention, the elongated central member includes an inner chamber which can house a scenting element, an electric lamp, or a plurality of rattling elements.

BRIEF DESCRIPTIONS OF THE DRAWINGS

FIG. 1 is a perspective view of the toy clapper of the present invention showing the plurality of resilient element in their radially extended position.

FIG. 2 is a front elevational view of the devices of FIG. 1 showing the resilient rib elements in the radially retracted position.

FIG. 3 is a top view taken substantially along lines 3—3 of FIG. 2.

FIG. 4 is a perspective view of the device of FIG. 2.

FIG. 5 is a bottom view taken substantially along lines 5—5 of FIG. 4.

FIG. 6 is a partial cross sectional view of the device of FIG. 2.

FIG. 7 is a depiction of the resilient rib elements of the present invention prior to attachment to the elongated central member.

FIG. 8 is a second embodiment of the present invention.

FIG. 9 is a third embodiment of the present invention.

DETAILED DESCRIPTION OF THE PREFERRED EMBODIMENTS

Now referring to FIGS. 1 through 5, toy 10 is comprised of elongated central member 12, sliding collar 14, and a plurality of resilient rib elements 16. Each resilient rib element 16 includes a first end which is attached to sliding collar 14 and a second end which is attached to elongated central member 12 preferably byway of cap 18. Sliding collar 14 is loosely fitted around elongated central member 12 such that it is free to slide 24 along the longitudinal axis 26 of elongated central member 12.

Resilient rib elements 16 are preferably constructed from any material that is some what flexible. One particular material that works exceptionally well is polyester film, commonly known by its trademark Mylar®. Preferably Mylar® 16, include a creased midportion 28. FIGS. 2 and 4 show the shape of the plurality of rib elements 16 when toy 10 is in its rest position. FIG. 1 depicts the radial extension of rib elements 16 when toy 10 is in its excited position. Toy 10 can be excited in one of two ways. The first way of exciting toy 10 is to simply grasp handle 22 and move toy 10 in an oscillating motion 24 parallel to longitudinal axis 26. This motion will cause sliding collar 14 to move in a oscillating way along longitudinal axis 26 thereby causing creased midportion 28 of plurality of resilient ribs 16 to move radially outwardly and inwardly 30. The second way to excite toy 10 is to rotate 32 handle 22 around longitudinal axis 26. This can be most effectively done by placing handle 22 between the right left hand of the user and rolling handle 22 between each hand. This rolling motion causes a centrifugal force to urge creased midsection 28 radially outwardly with respect to longitudinal axis 26. This urging in turn causes sliding collar 14 to move upwardly along central member 12 towards cap 18. When sliding collar 14 moves from the position shown in FIG. 1 to the position shown in FIGS. 2 and 4 it strikes against shoulder 34 of handle 22 thereby causing a clicking or clapping sound.

Elongated central member 12 includes stop element 20 (see FIG. 6) which limits the upward motion of sliding collar 14. If stop element 20 were not present it is possible that resilient rib element 16 might wrap around the top of cap 18 thereby entangling rib elements 16.

Now referring to FIGS. 6 through 9, preferably elongated central member 12 is comprised of clear plastic such as plexiglas, polyethylene, polypropylene, etc.

A preferred method for constructing resilient rib elements 16 is shown in FIG. 7 wherein a plurality of slits 38 are made in a single sheet of Mylar® 36. The midsection 28 of the Mylar® is creased which causes the Mylar® to deviate from its sheet geometry to that of a peaked geometry (best seen in FIG. 2 indicated by reference numeral 28). While slits 38 should pass through the thicker Mylar® 36, they should not completely traverse Mylar® sheet 36 but preferably terminate 40 short of the edge portion of mylar 36. This fabrication technique leaves the end portions of each resilient rib element 16 integrally attached to the Mylar® sheet which aids in handling the resilient rib elements 16 during assembly.

Cap 18 is sized such that it forms a tight, friction fit over Mylar® 36 to secure one end of Mylar® 36 to elongated central member 12. On the other hand, sliding collar 14 is glued or otherwise fastened to the opposite end of Mylar® sheet 36 such that sliding collar 14 is free to slide 24 along the longitudinal axis 26 whenever toy 10 is excited.

FIG. 6 depicts a first embodiment of the toy of the present invention wherein rattling elements 42 are contained within an inner chamber 41 of elongated central member 12. When toy 10 is excited, rattling elements 42 contact the wall portions of chamber 41 thereby producing a rattling sound.

In the second embodiment of the present invention, a scenting element 44 is contained within chamber 41. Holes

43 are place in cap 18, and in selected walls of chamber 41 so that the scent which emanates from scenting element 44 can be enjoyed.

In a third embodiment of the present invention an electric lamp element 46 is contained within chamber 41 along with switch 48 and battery 50 when switch 48 is turned on, electrical current flows from battery 50 through lamp 46. The light emitted from lamp 46 travels upward through translucent wall 52 and emanates from translucent side walls 54 of elongated central member 12.

Preferred embodiments of the present invention have been disclosed; however a person of ordinary skill in the art would realize that certain modifications fall within the teaching of this invention. Therefore the following claims should be constructed to cover the disclosed embodiments as well as all fair equivalents thereof.

I claim:

1. A toy, comprising:

an elongated central member having first and second ends and a longitudinal axis a sliding collar capturing said central member and adapted to slide freely along said central member a plurality of resilient rib elements each having first and second ends, wherein said first end of each resilient rib element is fixed to said central member and wherein said second end of each resilient rib element is fixed to said sliding collar, wherein each said resilient rib element urges said sliding collar away from said first end of each resilient rib element, and wherein each said resilient rib element is adapted to flex radially outwardly with respect to said longitudinal axis of said elongated central member, a handle fastened to said elongated central member wherein said handle includes a surface which forms a stop element for limiting the sliding movement of said sliding collar.

2. The toy of claim 1, wherein said resilient rib elements are comprised of polyester film.

3. The toy of claim 1, wherein said elongated central member is comprised of clear plastic tubing.

4. The toy of claim 1, wherein said elongated member includes an inner chamber wherein said inner chamber includes a plurality of rattling elements.

5. The toy of claim 1, wherein each said resilient rib element includes a creased mid-portion.

6. The toy of claim 1, wherein each said rib element is generally planar.

7. The toy of claim 1, wherein the plurality of resilient rib elements are formed from a single sheet of material wherein the first and second ends of each one of said plurality of resilient rib elements are integral with said sheet of material.

8. A toy, comprising:

an elongated central member having first and second ends and a longitudinal axis a sliding collar capturing said central member and adapted to slide freely along said central member a plurality of resilient rib elements each having first and second ends, wherein said first end of each resilient rib element is fixed to said central member and wherein said second end of each resilient rib element is fixed to said sliding collar, wherein each said resilient rib element urges said sliding collar away from said first end of each resilient rib element, and wherein each said resilient rib element is adapted to flex radially outwardly with respect to said longitudinal axis of said elongated central member, wherein each said resilient rib element includes a creased mid-portion.

* * * * *